US008128332B2

(12) United States Patent
Orgeron

(10) Patent No.: US 8,128,332 B2
(45) Date of Patent: Mar. 6, 2012

(54) HEADER STRUCTURE FOR A PIPE HANDLING APPARATUS

(75) Inventor: Keith J. Orgeron, Houston, TX (US)

(73) Assignee: T & T Engineering Services, Inc., Tomball, TX (US)

( * ) Notice: Subject to any disclaimer, the term of this patent is extended or adjusted under 35 U.S.C. 154(b) by 276 days.

(21) Appl. No.: 12/259,248

(22) Filed: Oct. 27, 2008

(65) Prior Publication Data

US 2010/0034619 A1 Feb. 11, 2010

Related U.S. Application Data

(63) Continuation-in-part of application No. 12/013,979, filed on Jan. 14, 2008, now Pat. No. 7,726,929, which is a continuation-in-part of application No. 11/923,451, filed on Oct. 24, 2007, now Pat. No. 7,918,636.

(51) Int. Cl.
*E21B 19/15* (2006.01)
*E21B 19/00* (2006.01)

(52) U.S. Cl. ..... 414/22.62; 414/22.55

(58) Field of Classification Search ..... 166/77.52, 166/77.53; 175/85; 269/139; 414/22.54, 414/22.55, 22.56, 22.57, 22.58, 22.59, 22.62, 414/222.04–222.06, 222.12, 226.04, 23, 414/546, 680, 729, 738, 740, 742, 744.7, 414/746.8, 749.6, 783, 694; 52/119, 120, 52/211, 213, 773, 86; 74/103, 110; 901/15, 901/21–22, 6; 212/292, 298, 306
See application file for complete search history.

(56) References Cited

U.S. PATENT DOCUMENTS

| | | | |
|---|---|---|---|
| 62,404 | A | 2/1867 | Gile et al. |
| 184,168 | A | 11/1876 | Nickle |
| 364,077 | A | 5/1887 | Addis |
| 514,715 | A | 2/1894 | Jenkins |
| 1,175,792 | A | 3/1916 | Mickelsen |
| 1,249,194 | A | 12/1917 | Race |
| 1,264,867 | A | 4/1918 | Schuh |
| 1,312,009 | A | 8/1919 | Thrift |
| 1,318,789 | A | 10/1919 | Moschel |
| 1,396,317 | A | 11/1921 | Boyter |

(Continued)

FOREIGN PATENT DOCUMENTS

EP 0024433 A1 3/1981

(Continued)

OTHER PUBLICATIONS

U.S. Appl. No. 11/923,451, filed Oct. 24, 2007, Orgeron, Keith J.

(Continued)

*Primary Examiner* — Gregory Adams
(74) *Attorney, Agent, or Firm* — John G. Fischer, Esq.; Scheef & Stone, L.L.P.

(57) ABSTRACT

A system has a pipe handling apparatus with an arm moving between a first position and a second position, a derrick having a window through which the pipe handling system delivers a pipe to a well head, and a header mounted in the window of the derrick. The header receives the arm of the pipe handling system when the arm is in the second position. An outside surface of the header suitably fits within the window of the derrick. An inside surface of the derrick suitably receives the arm. The inside surface resists an upward motion and a sideways motion of the arm. The header has a body that has a head and legs.

17 Claims, 7 Drawing Sheets

U.S. PATENT DOCUMENTS

| | | | | |
|---|---|---|---|---|
| 1,417,490 | A | 5/1922 | Brandon | |
| 1,483,037 | A * | 2/1924 | Zallinger | 52/86 |
| 1,768,861 | A * | 7/1930 | Richards | 52/86 |
| 1,972,635 | A | 9/1934 | Whinnen | |
| 1,981,304 | A | 11/1934 | Brandt | |
| 2,124,154 | A | 7/1937 | Sovincz | |
| 2,327,461 | A | 8/1943 | Rowe | |
| 2,328,197 | A * | 8/1943 | Cowin | 52/86 |
| 2,382,767 | A | 8/1945 | Zeilman | |
| 2,497,083 | A | 2/1950 | Hildebrand | |
| 2,509,853 | A | 5/1950 | Wilson | |
| 2,535,054 | A | 12/1950 | Ernst et al. | |
| 2,592,168 | A | 8/1952 | Morris et al. | |
| 2,710,431 | A * | 6/1955 | Griffon | 52/204.5 |
| 2,715,014 | A | 8/1955 | Garnett et al. | |
| 2,770,493 | A | 11/1956 | Fieber | |
| 2,814,396 | A | 11/1957 | Neal, Sr. | |
| 2,828,024 | A | 3/1958 | True | |
| 3,033,529 | A | 5/1962 | Pierrat | |
| 3,059,905 | A | 10/1962 | Tompkins | |
| 3,177,944 | A | 4/1965 | Knight | |
| 3,194,313 | A | 7/1965 | Fanshawe | |
| 3,262,593 | A | 7/1966 | Hainer | |
| 3,280,920 | A | 10/1966 | Scott | |
| 3,331,585 | A | 7/1967 | Dubberke | |
| 3,365,762 | A | 1/1968 | Spiri | |
| 3,421,269 | A * | 1/1969 | Medow | 52/86 |
| 3,464,507 | A | 9/1969 | Alexander | |
| 3,561,811 | A | 2/1971 | Turner, Jr. | |
| 3,633,771 | A | 1/1972 | Woolslayer et al. | |
| 3,702,640 | A | 11/1972 | Cintract et al. | |
| 3,703,968 | A | 11/1972 | Uhrich et al. | |
| 3,774,781 | A | 11/1973 | Merkley | |
| 3,806,021 | A | 4/1974 | Moroz et al. | |
| 3,823,916 | A | 7/1974 | Shaw | |
| 3,848,850 | A | 11/1974 | Bemis | |
| 3,860,122 | A | 1/1975 | Cernosek | |
| 3,883,009 | A | 5/1975 | Swoboda et al. | |
| 3,963,133 | A | 6/1976 | Gilli | |
| 3,986,619 | A | 10/1976 | Woolslayer et al. | |
| 3,991,887 | A | 11/1976 | Trout | |
| 3,995,746 | A | 12/1976 | Usagida | |
| 4,011,694 | A | 3/1977 | Langford | |
| 4,030,698 | A | 6/1977 | Hansen | |
| 4,044,952 | A | 8/1977 | Williams et al. | |
| 4,158,283 | A | 6/1979 | Nation | |
| 4,172,684 | A | 10/1979 | Jenkins | |
| 4,269,554 | A | 5/1981 | Jackson | |
| 4,276,918 | A | 7/1981 | Sigouin | |
| 4,303,270 | A | 12/1981 | Adair | |
| 4,336,840 | A | 6/1982 | Bailey | |
| 4,403,666 | A | 9/1983 | Willis | |
| 4,403,897 | A | 9/1983 | Willis | |
| 4,407,629 | A | 10/1983 | Willis | |
| 4,420,917 | A | 12/1983 | Parlanti | |
| 4,440,536 | A | 4/1984 | Scaggs | |
| 4,492,501 | A | 1/1985 | Haney | |
| 4,529,094 | A | 7/1985 | Wadsworth | |
| 4,595,066 | A | 6/1986 | Nelmark et al. | |
| 4,650,237 | A | 3/1987 | Lessway | |
| 4,708,581 | A | 11/1987 | Adair | |
| 4,759,414 | A | 7/1988 | Willis | |
| 4,765,401 | A | 8/1988 | Boyadjieff | |
| 4,822,230 | A | 4/1989 | Slettedal | |
| 4,834,604 | A | 5/1989 | Brittain et al. | |
| 4,869,137 | A | 9/1989 | Slator | |
| 4,982,853 | A | 1/1991 | Kishi | |
| 5,060,762 | A | 10/1991 | White | |
| 5,135,119 | A | 8/1992 | Larkin | |
| 5,186,264 | A | 2/1993 | du Chaffaut | |
| 5,415,057 | A | 5/1995 | Nihei et al. | |
| 5,458,454 | A | 10/1995 | Sorokan | |
| 5,597,987 | A | 1/1997 | Gilliland et al. | |
| 5,609,226 | A | 3/1997 | Penisson | |
| 5,649,745 | A | 7/1997 | Anderson | |
| 5,660,087 | A | 8/1997 | Rae | |
| 5,671,932 | A | 9/1997 | Chapman | |
| 5,806,589 | A | 9/1998 | Lang | |
| 5,848,647 | A | 12/1998 | Webre et al. | |
| 5,931,238 | A | 8/1999 | Gilmore et al. | |
| 5,964,550 | A | 10/1999 | Blandford et al. | |
| 5,992,801 | A | 11/1999 | Torres | |
| 5,993,140 | A | 11/1999 | Crippa | |
| 6,003,598 | A | 12/1999 | Andreychuk | |
| 6,158,516 | A | 12/2000 | Smith et al. | |
| 6,220,807 | B1 | 4/2001 | Sorokan | |
| 6,227,587 | B1 | 5/2001 | Terral | |
| 6,234,253 | B1 | 5/2001 | Dallas | |
| 6,253,845 | B1 | 7/2001 | Belik | |
| 6,263,763 | B1 | 7/2001 | Feigel, Jr. et al. | |
| 6,264,128 | B1 | 7/2001 | Shampine et al. | |
| 6,264,395 | B1 | 7/2001 | Allamon et al. | |
| 6,279,662 | B1 | 8/2001 | Sonnier | |
| 6,311,788 | B1 | 11/2001 | Weixler | |
| 6,343,892 | B1 | 2/2002 | Kristiansen | |
| 6,398,186 | B1 | 6/2002 | Lemoine | |
| 6,431,286 | B1 | 8/2002 | Andreychuk | |
| 6,471,439 | B2 | 10/2002 | Allamon et al. | |
| 6,502,641 | B1 | 1/2003 | Carriere et al. | |
| 6,543,551 | B1 | 4/2003 | Sparks et al. | |
| 6,543,555 | B2 | 4/2003 | Casagrande | |
| 6,557,641 | B2 | 5/2003 | Sipos et al. | |
| 6,581,698 | B1 | 6/2003 | Dirks | |
| 6,609,573 | B1 | 8/2003 | Day | |
| 6,705,414 | B2 | 3/2004 | Simpson et al. | |
| 6,745,646 | B1 | 6/2004 | Pietras et al. | |
| 6,748,823 | B2 | 6/2004 | Pietras | |
| 6,763,898 | B1 | 7/2004 | Roodenburg et al. | |
| 6,779,614 | B2 | 8/2004 | Oser | |
| 6,814,149 | B2 | 11/2004 | Liess et al. | |
| 6,845,814 | B2 | 1/2005 | Mason et al. | |
| 7,017,450 | B2 | 3/2006 | Bangert | |
| 7,028,440 | B2 * | 4/2006 | Brisson | 52/439 |
| 7,028,585 | B2 | 4/2006 | Pietras et al. | |
| 7,044,315 | B2 | 5/2006 | Willim | |
| 7,055,594 | B1 | 6/2006 | Springett et al. | |
| 7,077,209 | B2 | 7/2006 | McCulloch et al. | |
| 7,090,035 | B2 | 8/2006 | Lesko | |
| 7,090,254 | B1 | 8/2006 | Pietras et al. | |
| 7,117,938 | B2 | 10/2006 | Hamilton et al. | |
| 7,121,166 | B2 | 10/2006 | Drzewiecki | |
| 7,172,038 | B2 | 2/2007 | Terry et al. | |
| 7,289,871 | B2 | 10/2007 | Williams | |
| 7,296,623 | B2 | 11/2007 | Koithan et al. | |
| 7,398,833 | B2 | 7/2008 | Ramey et al. | |
| 7,438,127 | B2 | 10/2008 | Lesko | |
| 7,503,394 | B2 | 3/2009 | Bouligny | |
| 7,726,929 | B1 | 6/2010 | Orgeron | |
| 7,918,636 | B1 | 4/2011 | Orgeron | |
| 7,980,802 | B2 | 7/2011 | Orgeron | |
| 2002/0070187 | A1 | 6/2002 | Willim | |
| 2003/0221871 | A1 | 12/2003 | Hamilton et al. | |
| 2006/0151215 | A1 * | 7/2006 | Skogerbo | 175/52 |
| 2008/0078965 | A1 | 4/2008 | Lane et al. | |
| 2008/0174131 | A1 | 7/2008 | Bouligny et al. | |
| 2008/0202812 | A1 | 8/2008 | Childers et al. | |
| 2008/0253866 | A1 | 10/2008 | Lops et al. | |
| 2009/0232624 | A1 | 9/2009 | Orgeron | |
| 2010/0032213 | A1 | 2/2010 | Orgeron | |
| 2010/0034620 | A1 | 2/2010 | Orgeron | |
| 2010/0187740 | A1 | 7/2010 | Orgeron | |
| 2010/0296899 | A1 | 11/2010 | Orgeron | |
| 2011/0030942 | A1 | 2/2011 | Orgeron | |
| 2011/0200412 | A1 | 8/2011 | Orgeron | |

FOREIGN PATENT DOCUMENTS

| | | | |
|---|---|---|---|
| GB | 2264736 | A | 9/1993 |
| JP | 2001287127 | A | 10/2001 |
| WO | 9315303 | A1 | 8/1993 |
| WO | 2006038790 | A1 | 4/2006 |

OTHER PUBLICATIONS

U.S. Appl. No. 12/013,979, filed Jan. 14, 2008, Orgeron, Keith J.

U.S. Appl. No. 12/111,907, filed Apr. 29, 2008; non-published; titled "Pipe Gripping Apparatus" and having common inventors with the present patent application.

U.S. Appl. No. 12/371,590, filed Feb. 14, 2009; non-published; titled "Tubular Gripping Apparatus" and having common inventors with the present patent application.
U.S. Appl. No. 12/371,591, filed Feb. 14, 2009; non-published; titled "Gripping and Locking Method" and having common inventors with the present patent application.
U.S. Appl. No. 12/371,593, filed Feb. 14, 2009; non-published; titled "Pipe Handling Apparatus With Stab Frame Stiffening" and having common inventors with the present patent application.
U.S. Appl. No. 12/403,218, filed Mar. 12, 2009; non-published; titled "Derrickless Tubular Servicing System and Method" and having common inventors with the present patent application.
U.S. Appl. No. 12/418,302, filed Apr. 3, 2009; non-published; titled "Raise-Assist Pipe Handling" and having common inventors with the present patent application.
U.S. Appl. No. 12/469,598, filed May 20, 2009; non-published; titled "Alignment Apparatus and Method for a Boom of a Pipe Handling Apparatus" and having common inventors with the present patent application.
U.S. Appl. No. 12/632,261, filed Dec. 7, 2009; non-published; titled "Stabbing Apparatus and Method" and having common inventors with the present patent application.
U.S. Appl. No. 12/633,891, filed Dec. 9, 2009; non-published; titled "Stabbing Apparatus for Centering Tubulars and Casings for Connection at a Wellhead" and having common inventors with the present patent application.
U.S. Appl. No. 12/633,913, filed Dec. 9, 2009; non-published; titled "Apparatus for a Pipe Tong and Spinner Deployment" and having common inventors with the present patent application.
U.S. Appl. No. 12/789,332, filed May 27, 2010; non-published; titled "Pipe Handling Boom Pretensioning Appratus" and having common inventors with the present patent application.
U.S. Appl. No. 13/114,842, filed May 24, 2011; non-published; titled "Telescoping Jack for a Gripper Assembly" and having common inventors with the present patent application.
U.S. Appl. No. 13/226,343, filed Sep. 6, 2011; non-published; titled "Method of Gripping a Tubular With a Tubular Gripping Mechanism" and having common inventors with the present patent application.
Chronis, Nicholas P.; Mechanisms & Mechanical Devices Sourcebook, 1991, Ch. 10, pp. 399-414, ISBN 0-07-010918-4, McGraw-Hill, Inc.

* cited by examiner

HEADER STRUCTURE FOR A PIPE HANDLING APPARATUS

CROSS-REFERENCE TO RELATED U.S. APPLICATIONS

The present application is a continuation-in-part of U.S. application Ser. No. 12/013,979, filed on Jan. 14, 2008 now U.S. Pat. No. 7,726,929, entitled "Pipe Handling and Casing Stabbing Apparatus and Method", presently pending. U.S. application Ser. No. 12/013,979 is a continuation-in-part of U.S. application Ser. No. 11/923,451, filed on Oct. 24, 2007 now U.S. Pat. No. 7,918,636, entitled "Pipe Handling Apparatus and Method", presently pending.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to the delivery of tubulars from a horizontal orientation to a vertical orientation at a wellhead. More particularly, the present invention relates to pipe handling apparatus that positions tubulars at a wellhead. More particularly, the present invention relates to controlling undesirable forces that are created while positioning a tubular at a wellhead.

2. Description of Related Art Including Information Disclosed Under 37 CFR 1.97 and 37 CFR 1.98.

Drill rigs have utilized several methods for transferring tubular members from a pipe rack adjacent to the drill floor to a mousehole in the drill floor or the well bore for connection to a previously transferred tubular or tubular string. The term "tubular" as used herein includes all forms of pipe, drill pipe, drill collars, casing, liner, bottom hole assemblies (BHA), and other types of tubulars known in the art.

Conventionally, drill rigs have utilized a combination of the rig cranes and the traveling system for transferring a tubular from the pipe rack to a vertical position above the center of the well. The obvious disadvantage with the prior art systems is that there is a significant manual involvement in attaching the pipe elevators to the tubular and moving the pipe from the drill rack to the rotary table at the well head. This manual transfer operation in the vicinity of workers is potentially dangerous and has caused numerous injuries in drilling operations. Further, the hoisting system may allow the tubular to come into contact with the catwalk or other portions of the rig as the tubular is transferred from the pipe rack to the drill floor. This can damage the tubular and may affect the integrity of the connections between successive tubulars in the well.

One method of transferring pipe from the rack to the well platform comprises tying one end of a line on the rig around a selected pipe on the pipe rack. The pipe is thereafter lifted up onto the platform and the lower end thereof is placed into the mousehole. The mousehole is simply an upright, elongate cylindrical container adjacent to the rotary table which supports the pipe temporarily. When it is necessary to add the pipe to the drill string, slips are secured about the drill string on the rotary table thereby supporting the same in the well bore. The pipe is disconnected from the traveling equipment, and the elevators, or the kelly, are connected to the pipe in the mousehole. Next, the traveling block is raised by positioning the pipe over the drill string. Tongs are used to secure the pipe to the upper end of the drill string. The drill pipe elevators suspend the drill pipe from a collar, which is formed around one end of the pipe and does not clamp the pipe, thereby permitting rotational pipe movement in order to threadably engage the same to the drill string.

A prior art technique for moving joints of casing from racks adjacent to the drilling rig comprises tying a line from the rig onto one end of a selected casing joint on the rack. The line is raised by lifting the casing joint up a ramp leading to the rig platform. As the rope lifts the casing from the rack, the lower end of the casing swings across the platform in a dangerous manner. The danger increases when a floating system is used in connection with drilling. Because the rope is tied around the casing at one end thereof, the casing does not hang vertically, but rather tilts somewhat. A man working on a platform elevated above the rig floor must hold the top of the casing and straighten it out while the casing is threaded into the casing string which is suspended in the well bore by slips positioned on the rotary table.

It is desirable to be able to grip casing or pipe positioned on a rack adjacent a drilling well, move the same into vertical orientation over the well bore, and thereafter lower the same onto the string suspended in the well bore.

In the past, various devices have been created which mechanically move a pipe from a horizontal orientation to a vertical orientation such that the vertically-oriented pipe can be installed into the well bore. Typically, these devices have utilized several interconnected arms that are associated with a boom. In order to move the pipe, a succession of individual movements of the levers, arms, and other components of the boom must be performed in a coordinated manner in order to achieve the desired result. Typically, a wide variety of hydraulic actuators are connected to each of the components so as to carry out the prescribed movement. A complex control mechanism is connected to each of these actuators so as to achieve the desired movement. Advanced programing is required of the controller in order to properly coordinate the movements in order to achieve this desired result.

Unfortunately, with such systems, the hydraulic actuators, along with other components, can become worn with time. Furthermore, the hydraulic integrity of each of the actuators can become compromised over time. As such, small variations in each of the actuators can occur. These variations, as they occur, can make the complex mechanism rather inaccurate. The failure of one hydraulic component can exacerbate the problems associated with the alignment of the pipe in a vertical orientation. Adjustments of the programming are often necessary to as to continue to achieve the desired results. Fundamentally, the more hydraulic actuators that are incorporated into such a system, the more likely it is to have errors, inaccuracies, and deviations in the desired delivery profile of the tubular. Typically, very experienced and knowledgeable operators are required so as to carry out this pipe movement operation. This adds significantly to the cost associated with pipe delivery.

In the past, pipe handling apparatus have not been used for the installation of casing. The problem associated with casing is that the threads of the casing are formed on an inner wall and on an outer wall at the ends of each of the casing sections. Whenever these threads are formed, the relatively thin wall thickness of the casing is further minimized. Additionally, great precision is required so as to properly thread the threads of one casing section within the threads of an adjacent casing section. The amount of accuracy required for the delivery of the casing by a pipe handling apparatus, in the past, has not been sufficient so as to achieve the desired degree of accuracy for the installation of the casing sections in their threaded connection. The improper installation of one casing section upon another casing section can potentially damage the threads associated with such casing sections. Additionally, in the past, the pipe handling apparatus could potentially damage the thin-walled casing sections during the delivery. As such, a need has developed to adapt a pipe handling apparatus so as to achieve the desired amount of accuracy for the installation of casing sections.

To address these problems and needs, U.S. application Ser. No. 11/923,451, filed on Oct. 24, 2007, discloses a pipe handling apparatus that has a boom pivotally movable between a first position and a second position, a riser assembly pivotally connected to the boom, an arm pivotally connected at one end to the first portion of the riser assembly and extending outwardly therefrom, a gripper affixed to a opposite end of the arm suitable for gripping a diameter of the pipe, a link pivotally connected to the riser assembly and pivotable so as to move relative to the movement of the boom between the first and second positions, and a brace having one end pivotally connected to the boom and an opposite end pivotally connected to the arm between the ends of the arm. The riser assembly has a first portion extending outwardly at an obtuse angle with respect to the second portion.

The pipe handling apparatus delivers a pipe to a wellhead in the second position. Pipes can be of extraordinary lengths and weights. Once the pipe is connected to other pipe in the wellhead, the grippers of the pipe handling apparatus release the pipe. A problem associated with the pipe handling apparatus is that once the grippers release the pipe at the wellhead, the apparatus springs upwardly and away from the wellhead. This is due to the release of the massive weight of the pipe. This springback causes unnecessary stresses on the pipe handling apparatus and can cause structural damage to the apparatus, such as cracking and bending. Upon the release of the pipe, the grippers and the arm of the pipe handling apparatus can have a springback of up to ten inches. In addition to creating unnecessary stresses on the apparatus, the springback can cause the pipe to be deflected at the wellhead. Moreover, the accuracy of the pipe handling apparatus decreases when this springback occurs. Thus, there is a need to avoid the springback and minimize the deflection of the apparatus that is caused by the release of the pipe at the wellhead. These problems also occur when casing is delivered to the wellhead by the pipe handling apparatus.

Various patents and patent applications relate to apparatus and methods for stiffening and improving the integrity of a pipe handling system. For example, U.S. patent application Ser. No. 12/013,979, filed on Jan. 14, 2008 by the present inventor, discloses a pre-loading system for a pipe handling apparatus in which a boom is pivotally mounted at one end to a skid and in which an arm is interconnected to an opposite end of the boom. The pre-loading system has a tensioning system with one end affixed to the arm and an opposite end fixedly mounted so as to apply tension to the arm when the arm has a load applied to an end of the arm opposite the boom. The tensioning system includes a first cable assembly having one end interconnected to the arm and an opposite end fixedly mounted, and a second cable assembly interconnected to the arm and having an opposite end fixedly mounted. The first and second cable assemblies extend from opposite sides of the arm.

U.S. patent application Ser. No. 11/923,451, filed on Oct. 24, 2007 by the present inventor, discloses a pipe handling apparatus that has a boom pivotally movable between a first position and a second position, a riser assembly pivotally connected to the boom, an arm pivotally connected at one end to the first portion of the riser assembly and extending outwardly therefrom, a gripper affixed to a opposite end of the arm suitable for gripping a diameter of the pipe, a link pivotally connected to the riser assembly and pivotable so as to move relative to the movement of the boom between the first and second positions, and a brace having a one end pivotally connected to the boom and an opposite end pivotally to the arm between the ends of the arm. The riser assembly has a first portion extending outwardly at an obtuse angle with respect to the second portion.

U.S. Pat. No. 3,177,944, issued on Apr. 13, 1965 to R. N. Knight, describes a racking mechanism for earth boring equipment that provides for horizontal storage of pipe lengths on one side of and clear of the derrick. This is achieved by means of a transport arm which is pivoted toward the base of the derrick for swing movement in a vertical plane. The outer end of the arm works between a substantially vertical position in which it can accept a pipe length from, or deliver a pipe length to, a station in the derrick, and a substantially horizontal portion in which the arm can deliver a pipe length to, or accept a pipe length from, a station associated with storage means on one side of the derrick.

U.S. Pat. No. 3,464,507, issued on Sep. 2, 1969 to E. L. Alexander et al., teaches a portable rotary pipe handling system. This system includes a mast pivotally mounted and movable between a reclining transport position to a desired position at the site drilling operations which may be at any angle up to vertical. The mast has guides for a traveling mechanism that includes a block movable up and down the mast through operation of cables reeved from the traveling block over crown block pulleys into a drawwork. A power drill drive is carried by the traveling block. An elevator for drill pipe is carried by an arm swingably mounted relative to the power unit. Power tongs, slips, and slip bushings are supported adjacent the lower end of the mast and adapted to have a drill pipe extend therethrough from a drive bushing connected to a power drive whereby the drill pipe is extended in the direction of the hole to be drilled.

U.S. Pat. No. 3,633,771, issued on Jan. 11, 1972 to Woolslayer et al., discloses an apparatus for moving drill pipe into and out of an oil well derrick. A stand of pipe is gripped by a strongback which is pivotally mounted to one end of a boom. The boom swings the strongback over the rotary table thereby vertically aligning the pipe stand with the drill string. When both adding pipe to and removing pipe from the drill string, all vertical movement of the pipe is accomplished by the elevator suspended from the traveling block.

U.S. Pat. No. 3,860,122, issued on Jan. 14, 1975 to L. C. Cernosek, describes an apparatus for transferring a tubular member, such as a pipe, from a storage area to an oil well drilling platform. The positioning apparatus includes a pipe positioner mounted on a platform for moving the pipe to a release position whereby the pipe can be released to be lowered to a submerged position. A loader is operably attached or associated with the platform and a positioner in order to move the pipe from a stored position to a transfer position in which the pipe is transferred to the positioner. The positioner includes a tower having a pipe track pivotally mounted thereon with pipe clamp assemblies which are adapted to receive a pipe length. The pipe track is pivotally movable by a hydraulic power mechanism or gear mechanism between a transfer position in which pipe is moved into the clamp assemblies and the release position in which the pipe is released for movement to a submerged position.

U.S. Pat. No. 3,986,619, issued on Oct. 19, 1976 to Woolslayer et al., shows a pipe handling apparatus for an oil well drilling derrick. An inner end of the boom is pivotally supported on a horizontal axis in front of a well. A clamping means is pivotally connected to the outer end of the boom on an axis parallel to the horizontal axis at one end. The clamping means allows the free end of the drill pipe to swing across the boom as the outer end of the boom is raised or lowered. A line is connected at one end with the traveling block that raises and lowers the elevators and at the other end to the boom so as to pass around sheaves.

U.S. Pat. No. 4,172,684, issued on Oct. 30, 1979 to C. Jenkins, shows a floor-level pipe handling apparatus which is mounted on the floor of an oil well derrick. The apparatus includes a support that is rockable on an axis perpendicular to the centerline of a well being drilled. One end of an arm is pivotally mounted on the support on an axis transverse to the centerline of the well. The opposite end of the arm carries a pair of shoes having laterally opening pipe-receiving seats facing away from the arm. The free end of the arm can be swung toward and away from the well centerline and the arm support can be rocked to swing the arm laterally.

U.S. Pat. No. 4,403,666, issued on Sep. 13, 1983 to C. A. Willis, shows self-centering tongs and a transfer arm for a drilling apparatus. The clamps of the transfer arm are resiliently mounted to the transfer arm so as to provide limited axial movement of the clamps and thereby of a clamped down hole tubular. A pair of automatic, self-centering, hydraulic tongs are provided for making up and breaking out threaded connections of tubulars.

U.S. Pat. No. 4,407,629, issued on Oct. 4, 1983 to C. A. Willis, teaches a lifting apparatus for downhole tubulars. This lifting apparatus includes two rotatably mounted clamps which are rotatable between a side-loading position so as to facilitate the loading and unloading in the horizontal position, and a central position, in which a clamped tubular is aligned with the drilling axis when the boom is in the vertical position. An automatic hydraulic sequencing circuit is provided to automatically rotate the clamps into the side-loading position whenever the boom is pivoted with a downhole tubular positioned in the clamp. In this position, the clamped tubular is aligned with a safety plate mounted on the boom to prevent a clamped tubular from slipping from the clamps.

U.S. Pat. No. 4,492,501 provides a platform positioning system for a drilling operation which includes a support structure and a transfer arm pivotally connected to the support structure to rotate about a first axis. This platform positioning system includes a platform which is pivotally connected to the support structure to rotate about a second axis, and a rod which is mounted between the transfer arm and the platform. The position of the arm and platform axes and the length of the rod are selected such that the transfer arm automatically and progressively raises the platform to the raised position by means of the rod as the transfer arm moves to the raised position. The transfer arm automatically and progressively lowers the platform to the lowered position by means of the rod as the transfer arm moves to the lowered position.

U.S. Pat. No. 4,595,066, issued on Jun. 17, 1986 to Nelmark et al., provides an apparatus for handling drill pipes and used in association with blast holes. This system allows a drill pipe to be more easily connected and disconnected to a drill string in a hole being drilled at an angle. A receptacle is formed at the lower end of the carrier that has hydraulically-operated doors secured by a hydraulically-operated lock. A gate near the upper end is pneumatically operated in response to the hydraulic operation of the receptacle lock.

U.S. Pat. No. 4,822,230, issued on Apr. 18, 1989 to P. Slettedal, teaches a pipe handling apparatus which is adapted for automated drilling operations. Drill pipes are manipulated between substantially horizontal and vertical positions. The apparatus is used with a top mounted drilling device which is rotatable about a substantially horizontal axis. The apparatus utilizes a strongback provided with clamps to hold and manipulate pipes. The strongback is rotatably connected to the same axis as the drilling device. The strongback moves up or down with the drilling device. A brace unit is attached to the strongback to be rotatable about a second axis.

U.S. Pat. No. 4,834,604, issued on May 30, 1989 to Brittain et al., provides a pipe moving apparatus and method for moving casing or pipe from a horizontal position adjacent a well to a vertical position over the well bore. The machine includes a boom movable between a lowered position and a raised position by a hydraulic ram. A strongback grips the pipe and holds the same until the pipe is vertically positioned. Thereafter, a hydraulic ram on the strongback is actuated thereby lowering the pipe or casing onto the string suspended in the well bore and the additional pipe or casing joint is threaded thereto.

U.S. Pat. No. 4,708,581 issued on Nov. 24, 1987 H. L. Adair, provides a method for positioning a transfer arm for the movement of drill pipe. A drilling mast and a transfer arm is mounted at a first axis adjacent the mast to move between a lowered position near ground level and an upper position aligned with the mast. A reaction point anchor is fixed with respect to the drilling mast and spaced from the first axis. A fixed length link is pivotably mounted to the transfer arm at a second axis, spaced from the first axis, and a first single stage cylinder is pivotably mounted at one end to the distal end of the link and at the other end to the transfer arm. A second single stage hydraulic cylinder is pivotably mounted at one end to the distal end of the link and at the other end to the reaction point.

U.S. Pat. No. 4,759,414, issued on Jul. 26, 1988 to C. A. Willis, provides a drilling machine which includes a drilling superstructure skid which defines two spaced-apart parallel skid runners and a platform. The platform supports a drawworks mounted on a drawworks skid and a pipe boom is mounted on a pipe boom skid sized to fit between the skid runners of the drilling substructure skid. The drilling substructure skid supports four legs which, in turn, support a drilling platform on which is mounted a lower mast section. The pipe boom skid mounts a pipe boom as well as a boom linkage, a motor, and a hydraulic pump adapted to power the pipe boom linkage. Mechanical position locks hold the upper skid in relative position over the lower skid.

U.S. Pat. No. 5,458,454, issued on Oct. 17, 1995 to R. S. Sorokan, describes a pipe handling method which is used to move tubulars used from a horizontal position on a pipe rack adjacent the well bore to a vertical position over the well center. This method utilizes bicep and forearm assemblies and a gripper head for attachment to the tubular. The path of the tubular being moved is close to the conventional path of the tubular utilizing known cable transfer techniques so as to allow access to the drill floor through the V-door of the drill rig. U.S. Pat. No. 6,220,807 describes an apparatus for carrying out the method of U.S. Pat. No. 5,458,454.

U.S. Pat. No. 6,609,573, issued on Aug. 26, 2003 to H. W. F. Day, teaches a pipe handling system for an offshore structure. The pipe handling system transfers the pipes from a horizontal pipe rack adjacent to the drill floor to a vertical orientation in a set-back area of the drill floor where the drill string is made up for lowering downhole. The cantilevered drill floor is utilized with the pipe handling system so as to save platform space.

U.S. Pat. No. 6,705,414, issued on Mar. 16, 2004 to Simpson et al., describes a tubular transfer system for moving pipe between a substantial horizontal position on the catwalk and a substantially vertical position at the rig floor entry. Bundles of individual tubulars are moved to a process area where a stand make-up/break-out machine makes up the tubular stands. The bucking machine aligns and stabs the connections and makes up the connection to the correct torque. The tubular stand is then transferred from the machine to a stand storage area. A trolley is moved into position over the pick-up area to retrieve the stands. The stands are clamped to the trolley and the trolley is moved from a substantially horizontal position to a substantially vertical position at the rig floor entry. A vertical pipe-racking machine transfers the stands to the traveling equipment. The traveling equipment makes up the stand connection and the stand is run into the hole.

U.S. Pat. No. 6,779,614, issued on Aug. 24, 2004 to M. S. Oser, shows another system and method for transferring pipe. A pipe shuttle is used for moving a pipe joint into a first position and then lifting upwardly toward an upper second position.

It is an object of the present invention to provide a system and method for preventing the springback of a pipe handling apparatus when delivering a pipe to a wellhead.

It is another object of the present invention to provide a system and method for stiffening a pipe handling apparatus that minimizes the amount of calibration required in order to move the pipe from a horizontal orientation to a vertical orientation.

It is another object of the present invention to provide a system and method for stiffening a pipe handling apparatus that operates within a single degree of freedom so as to move the pipe without adjustments between the components.

It is still another object of the present invention to provide a system and method for stiffening a pipe handling apparatus that utilizes an existing derrick.

It is another object of the present invention to provide a system and method for stiffening a pipe handling apparatus that prevents damages of the components of the pipe handling apparatus.

It is another object of the present invention to provide a system and method for stiffening a pipe handling apparatus that prevents sideways motions of the pipe handling apparatus caused by wind.

It is another object of the present invention to provide a system and method for stiffening that achieves greater precession in the delivery and installation of pipe and/or casing.

It is another object of the present invention to provide a system and method for stiffening a pipe handling apparatus that increases the structural stiffness of the system.

These and other objects and advantages of the present invention will become apparent from a reading of the attached specification and appended claims.

BRIEF SUMMARY OF THE INVENTION

The present invention is a system for installing a pipe comprising a pipe handling apparatus having a first position and a second position, a derrick having a window through which the pipe handling apparatus delivers a pipe to a well head, and a header mounted in the window of the derrick. The header receives a portion of the pipe handling apparatus when the pipe handling apparatus is in the second position.

The pipe handling apparatus comprises a boom pivotally movable between a first position and a second position, a lever assembly pivotally connected to the boom, an arm having an end pivotally connected to the lever assembly and extending outwardly therefrom when the boom is in the second position, and a gripper means affixed to an opposite end of the arm for gripping a diameter of the pipe. The header receives a portion of the arm when the boom is in the second position.

The derrick has a plurality of structural members. The plurality of structural members arranged so as to form the window. The plurality of structural members form an inverted V-shape. The window has a top and a bottom. The header is mounted adjacent the top of the window. The header is mounted to the plurality of structural members so as to extend in a generally horizontal orientation or in generally parallel relation to the floor of the derrick.

The header has an outside surface and an inside surface. The outside surface is formed so as to suitably fit within the window of the derrick. The inside surface is formed so as to suitably receive the arm. The inside surface resists an upward motion of the arm. The inside surface of the header exerts a vertical force on the arm. The inside surface resists a sideways motion of the arm. The inside surface of the header exerts a horizontal force on the arm.

The header has a body. The body has a head and at least one leg. The head and leg are integrally formed. The head is mounted in the window so as to resist an upward motion of the arm when the pipe handling apparatus is in the second position. The leg extends downwardly from the head of the body. The leg is mounted in the window so as to resist a sideways motion of the arm when the pipe handling apparatus is in the second position. The body has a shape suitable for mounting in the window and suitable for receiving the arm therein. The head receives the arm when the pipe handling apparatus is in the second position. The leg receives the arm when the pipe handling apparatus is in the second position.

The present invention is a method of moving a pipe from a horizontal orientation for installation in a vertical orientation. The method includes the steps of extending a boom over the horizontally-oriented pipe such that grippers are positioned adjacent to the horizontally-oriented pipe, gripping the horizontally-oriented pipe with the grippers, pivoting the boom upwardly such that the pipe is moved angularly through an interior of the boom and until the pipe is in a vertical orientation, and receiving a portion of the arm in a header mounted in a window of a derrick. The grippers are affixed to an arm pivotally connected to a lever assembly. The lever assembly is pivotally mounted to the boom. The method further includes the steps of moving the arm and the grippers and the pipe through the window of the derrick, delivering the pipe to a well head in the vertical orientation, releasing the pipe at the well head in the vertical orientation, resisting an upward motion of the arm with the header, and resisting a sideways motion of the arm with the header. The method also includes forming an outside surface of the header so as to suitably fit in the window of the derrick, forming an inside surface of the header so as to suitably receive the portion of the arm, and mounting the header in the window of the derrick.

DETAILED DESCRIPTION OF THE INVENTION

Figure 1:
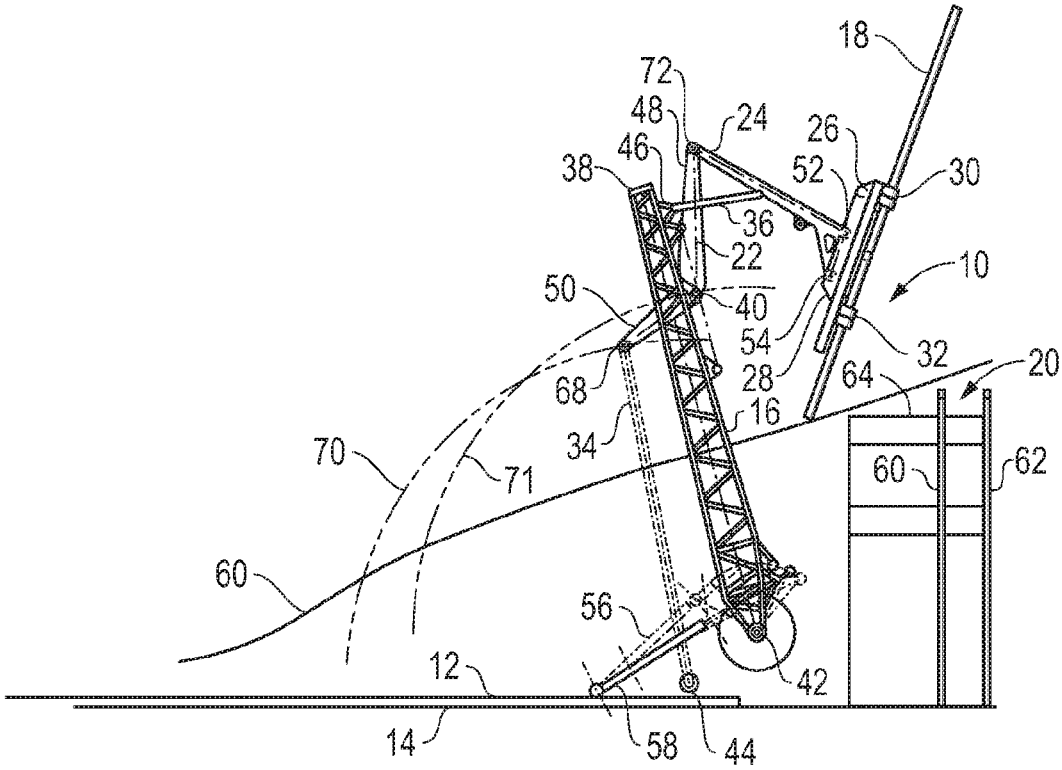
FIG. 1 is a side elevation view showing the pipe handling apparatus in accordance with the teachings of the preferred embodiment of the present invention.

Referring to FIG. 1, there is shown the pipe handling apparatus 10 in accordance with the system of the present invention. The pipe handling apparatus 10 is mounted on a skid 12 that is supported upon the bed 14 of a vehicle, such as a truck. The pipe handling apparatus 10 in particular includes a boom 16 that is pivotally movable between a first position and a second position. In FIG. 1, an intermediate position of the pipe handling apparatus 10 is particularly shown. In this position, the pipe 18 is illustrated in its position prior to installation on the drill rig 20. A lever assembly 22 is pivotally connected to the boom 16. An arm 24 is pivotally connected to an end of the lever assembly 22 opposite the boom 16. A gripping means 26 is fixedly connected to an opposite end of the arm 24 opposite the lever assembly 22. The gripping means 26 includes a body 28 and grippers 30 and 32. A link 34 has one end pivotally connected to the skid 12 and an opposite end pivotally connected to the end of the lever assembly 22 opposite the arm 24. A brace 36 is pivotally connected to the boom 16 and also pivotally connected to the arm 24 between the lever assembly 22 and the body 28 of gripping means 26.

In the present invention, the boom 16 is a structural framework of struts, cross members and beams. In particular, in the present invention, the boom 16 is configured so as to have an open interior such that the pipe 18 will be able to be lifted in a manner so as to pass through the interior of the boom 16. As such, the end 38 of the boom 16 should be strongly reinforced so as to provide the necessary structural integrity to the boom 16. A lug 40 extends outwardly from one side of the boom 16. This lug 40 is suitable for pivotable connection to the lever assembly 22. The boom 16 is pivotally connected at the opposite end 42 to a location on the skid 12. The pivotable connection at end 42 of the boom 16 is located in offset relationship and above the pivotable connection 44 of the link 34 with the skid 12. A small frame member 46 extends outwardly from the side of the boom 16 opposite the link 34. This frame assembly 46 has a pivotable connection with the brace 36.

The lever assembly 22 includes a first portion 48 and a second portion 50. The first portion 48 extends at an obtuse angle with respect to the second portion 50. The link 34 is pivotally connected to the end of the second portion 50 opposite the first portion 48. The arm 24 is pivotally connected to the end of the first portion 48 opposite the second portion 50. The lug 40 of the boom 16 is pivotally connected in an area generally between the first portion 48 and the second portion 50. This unique arrangement of the lever assembly 22 facilitates the ability of the present invention to carry out the movement of the pipe 18 between the horizontal orientation and the vertical orientation.

The arm 24 has an end pivotally connected to the end of the first portion 48 of the lever assembly 22. The opposite end of the arm 24 is connected to the gripping means 26. In particular, a pair of pin connections engage a surface of the body 28 of the gripping means 26 so as to fixedly position the gripping means 26 with respect to the end of the arm 24. The pin connections 52 and 54 can be in the nature of bolts, or other fasteners, so as to strongly connect the body 28 of the gripping means 26 with the arm 24. The bolts associated with pin connections 52 and 54 can be removed such that other gripping means 26 can be affixed to the end of the arm 24. As such, the pipe handling apparatus 10 of the present invention can be adaptable to various sizes of pipe 18 and various heights of drilling rigs 20.

The gripping means 26 includes the body 28 with the grippers 30 and 32 translatable along the length of the body 28. This vertical translation of the grippers 30 and 32 allows the pipe 18 to be properly moved upwardly and downwardly once the vertical orientation of the pipe 18 is achieved. The grippers 30 and 32 are in the nature of conventional grippers which can open and close so as to engage the outer diameter of the pipe 18, as desired.

The link 34 is an elongate member that extends from the pivotable connection 44 to the pivotable connection 68 of the second portion 50 of the lever assembly 22. The link 34 is non-extensible and extends generally adjacent to the opposite side from the boom 16 from that of the arm 24. The link 34 will generally move relative to the movement of the boom 16. The brace 36 is pivotally connected to the small framework 46 associated with boom 16 and also pivotally connected at a location along the arm 26 between the ends thereof. Brace 36 provides structural support to the arm 24 and also facilitates the desired movement of the arm 24 during the movement of the pipe 18 between the horizontal orientation and the vertical orientation.

Actuators 56 and 58 are illustrated as having one end connected to the skid 12 and an opposite end connected to the boom 16 in a location above the end 42. When the actuators 56 and 58 are activated, they will pivot the boom 16 upwardly from the horizontal orientation ultimately to a position beyond vertical so as to cause the pipe 18 to achieve a vertical orientation. Within the concept of the present invention, a single hydraulic actuator can be utilized instead of the pair of hydraulic actuators 56 and 58, as illustrated in FIG. 1.

The drilling rig 20 is illustrated as having drill pipes 60 and 62 extending upwardly so as to have an end above the drill floor 64. When the pipe 18 is in its vertical orientation, the translatable movement of the grippers 30 and 32 can be utilized so as to cause the end of the pipe 18 to engage with the box of one of the drill pipes 60 and 62.

In FIG. 1, the general movement of the bottom end of the pipe 18 is illustrated by line 66. The movement of the pivot point 68 of the connection between the lever assembly 22 and the link 34 is illustrated by line 70. Curved line 71 illustrates the movement of the pivotable connection 40 between the boom 16 and the lever assembly 22.

In the present invention, the coordinated movement of each of the non-extensible members of the apparatus 10 is achieved with proper sizing and angular relationships. In essence, the present invention provides a four-bar link between the various components. As a result, the movement of the drill pipe 18 between a horizontal orientation and a vertical orientation can be achieved purely through the mechanics associated with the various components. As can be seen, only a single hydraulic actuator may be necessary so as to achieve this desired movement. There does not need to be coordinated movement of hydraulic actuators. The hydraulic actuators are only used for the pivoting of the boom. Since the skid 12 is located on the bed of a vehicle 14, the vehicle 14 can be maneuvered into place so as to properly align with the centerline of the drill pipe 60 and 62 of the drilling rig 20. Once the proper alignment is achieved by the vehicle 14, the apparatus 10 can be operated so as to effectively move the drill pipe to its desired position. The gripper assemblies of the present invention allow the drill pipe 18 to be moved upwardly and downwardly for the proper stabbing of the drill pipes 60 and 62. The present invention is adaptable to various links of pipe 18.

Various types of gripping means 26 can be installed on the end of the arm 24 so as to properly accommodate longer lengths of pipe 18. These variations are illustrated herein in connections FIGS. 6-9.

As such, instead of the complex control mechanisms that are required with prior art systems, the present invention achieves it results by simple maneuvering of the vehicle 14, along with operation of the hydraulic cylinders 56 and 58. All other linkages and movement of the pipe 18 are achieved purely because of the mechanical connections between the various components. As such, the present invention assures a precise, self-centering of the pipe 18 with respect to the desired connecting pipe. This is accomplished with only a single degree of freedom in the pipe handling system.

Figure 2:
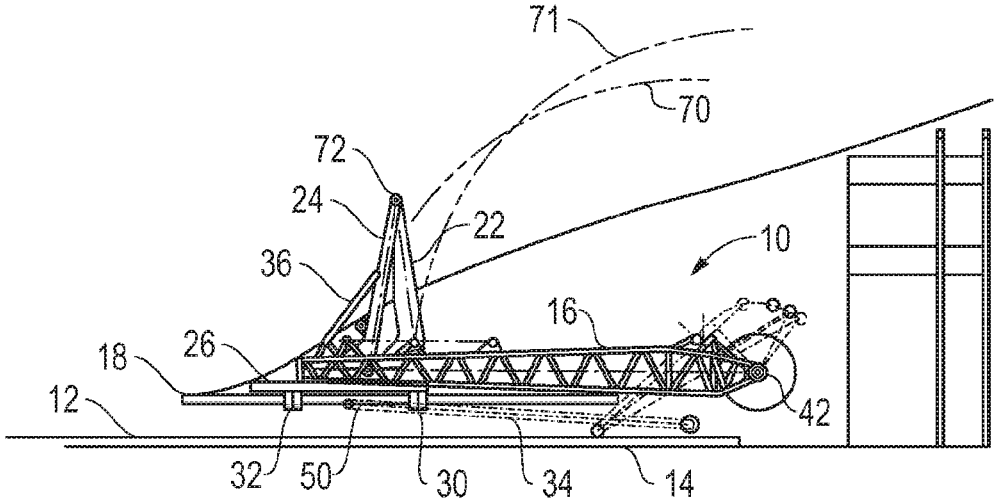
FIG. 2 is a side elevational view showing the pipe handling apparatus in a first position.

FIG. 2 illustrates the drill pipe 18 in a generally horizontal orientation. In the present invention, it is important to note that the drill pipe can be delivered to the apparatus 10 in a position below the boom 16. In particular, the drill pipe can be loaded upon the skid 12 in a location generally adjacent to the grippers 30 and 32 associated with the gripping means 26. As such, the present invention facilitates the easy delivery of the drill pipe to the desired location. The gripper 30 and 32 will grip the outer diameter of the pipe 18 in this horizontal orientation.

In FIG. 2, it can be seen that the boom 16 resides above the drill pipe 18 and in generally parallel relationship to the top surface of the skid 12. The lever assembly 22 is suitably pivoted so that the arm 24 extends through the interior of the framework of the boom 16 and such that the gripping means 26 engages the pipe 18. The brace 36 resides in connection with the small framework of the boom 16 and also is pivotally connected to the arm 24. The link 34 will reside below the boom 16 generally adjacent to the upper surface of the skid 12 and is connected to the second portion 50 of the lever assembly 22 below the boom 16.

Figure 3:
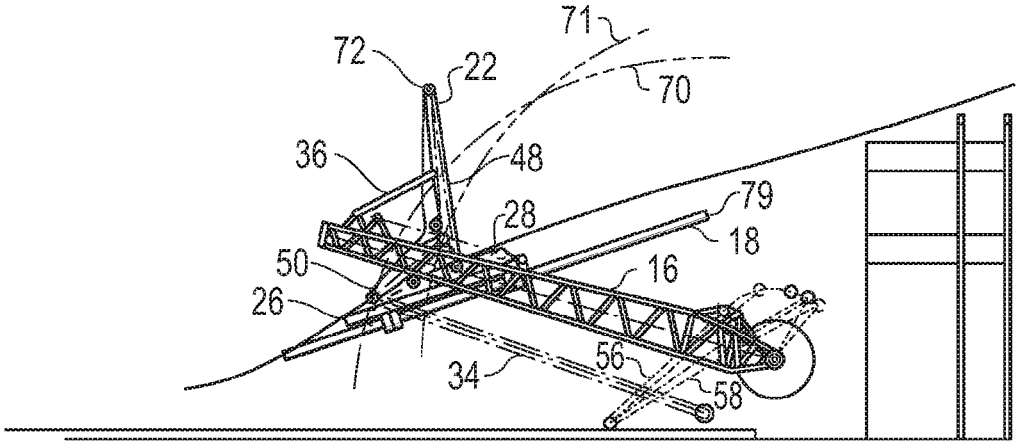
FIG. 3 is a side elevational view showing the pipe handling apparatus moving from the first position toward the second position.

FIG. 3 shows an intermediate position of the drill pipe 18 during the movement from the horizontal orientation to the vertical orientation. As can be seen, the gripping means 26 has engaged with the pipe 18. The lever assembly 22 is pivoting so that the end 79 of pipe 18 will pass through the interior of the framework of the boom 16. Also, the arm associated with the gripping means 26 serves to move the body 28 of the gripping means 26 through the interior of the framework of the boom 16. The brace 36 is pulling on the first portion 48 of lever assembly 22 so as to cause this motion to occur. The link 34 is pulling on the end of the second portion 50 of the lever assembly 22 so as to draw the first portion 48 upwardly and to cause the movement of the body 28 of the gripping means 26. The hydraulic actuators 56 and 58 have been operated so as to urge the boom 16 pivotally upwardly.

Figure 4:
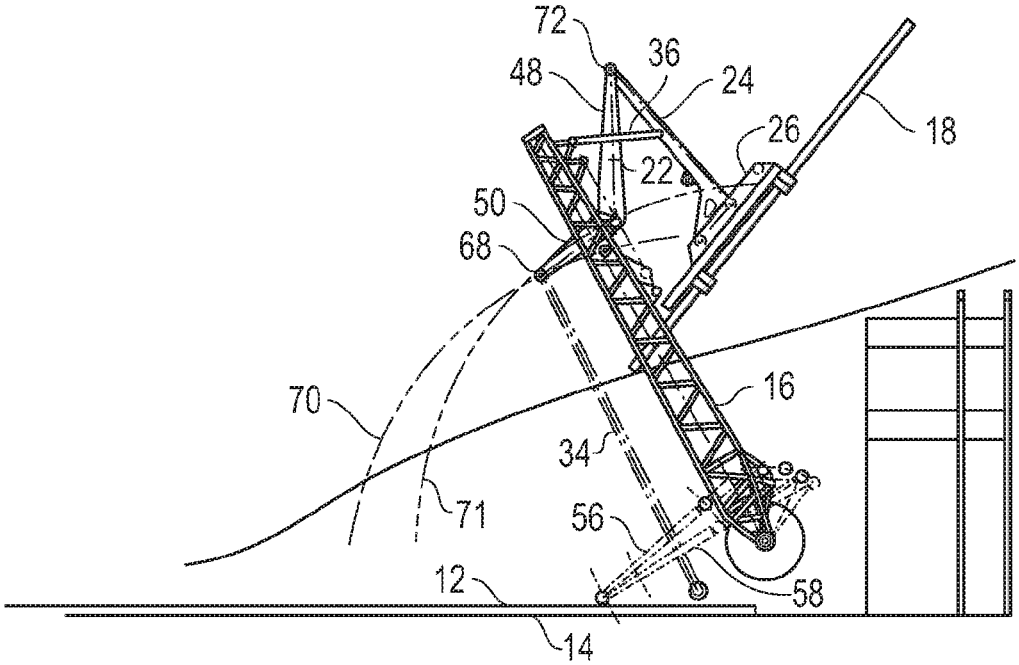
FIG. 4 is a side elevation view of the pipe handling apparatus showing the pipe handling apparatus as moving the pipe further to the second position.

FIG. 4 shows a further intermediate movement of the drill pipe 18. Once again, the hydraulic actuators 56 and 58 urge the boom 16 angularly upwardly away from the top surface of the skid 12. This causes the link 34 to have a pulling force on the pivotal connection 68 of the second portion 50 of the lever assembly 22. This causes the first portion 48 of the lever assembly 22 to move upwardly thereby causing the arm 24, in combination with the brace 36 to lift the gripping means 26 further upwardly and draw the pipe 18 completely through the interior of the boom 16. As can be seen, the relative size and relation of the various components of the present invention achieve the movement of the pipe 18 without the need for separate hydraulic actuators.

Figure 5:
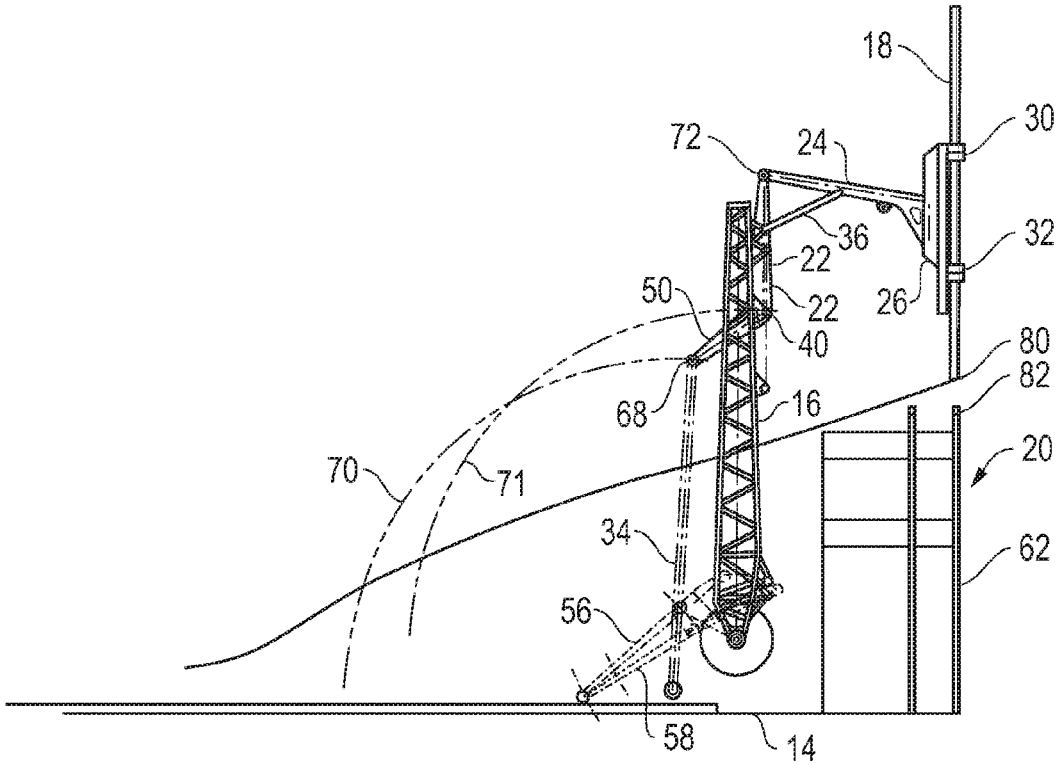
FIG. 5 is a side elevational view showing the pipe handling apparatus in its second position in which the pipe extends in a vertical orientation.

FIG. 5 illustrates the drill pipe 18 in its vertical orientation. As can be seen, the drill pipe 18 is positioned directly above the underlying pipe 62 on the drilling rig 20. The further upward pivotal movement of the boom 16 is caused by the hydraulic cylinders 56 and 58. This causes the link 34 to rotate and draw the end of the second portion 50 of the lever assembly 22 downwardly. The lever assembly 22 rotates about the pivot point 40 such that the first portion 48 of the lever assembly 22 has a pivot 72 at its upper end. The brace 36 is now rotated in a position so as to provide support for the arm 24 in this upper position. The gripping means 26 has grippers 30 and 32 aligned vertically and in spaced parallel relationship to each other. If any further precise movement is required between the bottom end 80 of the pipe 18 and the upper end 82 of pipe 62, then the vehicle 14 can be moved slightly so as to achieve further precise movement. In the manner described hereinbefore, the drill pipe 18 has achieved a completely vertical orientation by virtue of the interrelationship of the various components of the present invention and without the need for complex control mechanisms and hydraulics.

In order to install the drill pipe 18 upon the pipe 62, it is only necessary to vertically translate the grippers 30 and 32 within the body 28 of the gripping means 26. As such, the end 80 can be stabbed into the box connection 82 of pipe 62. Suitable tongs, spinners, or other mechanisms can be utilized so as to rotate the pipe 18 in order to achieve a desired connection. The grippers 30 and 32 can then be released from the exterior of the pipe 18 and returned back to the original position such that another length of drill pipe can be installed.

Figure 6:
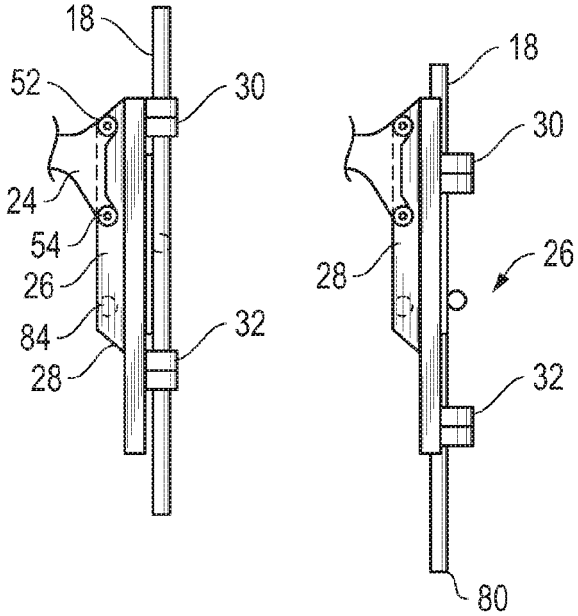
FIG. 6 is an illustration of the gripper assembly as vertically translating the pipe.

FIG. 6 is a detailed view of the gripping means 26 of the present invention. In FIG. 6 the pin connections 52 and 54 have been installed into alternative holes formed on the body 28 of the gripping means 26. The holes, such as hole 84 can be formed in a surface of the body 28 so as to allow selective connection between the end of the arm 24 and the body 28 of gripping means 26. As such, the position of the gripping means 26 in relation to the arm 24 can be adapted to various circumstances.

It can be seen that the pipe 18 is engaged by grippers 30 and 32 of the gripping means 26. The configuration of the grippers 30 and 32, as shown in FIG. 6, is particularly designed for short length (approximately 30 feet) of drill pipe. In FIG. 6, it can be seen that the grippers 30 and 32 are translated relative to the body 28 so as to lower end 80 of pipe 18 downwardly for connection to an underlying pipe.

Figure 7:
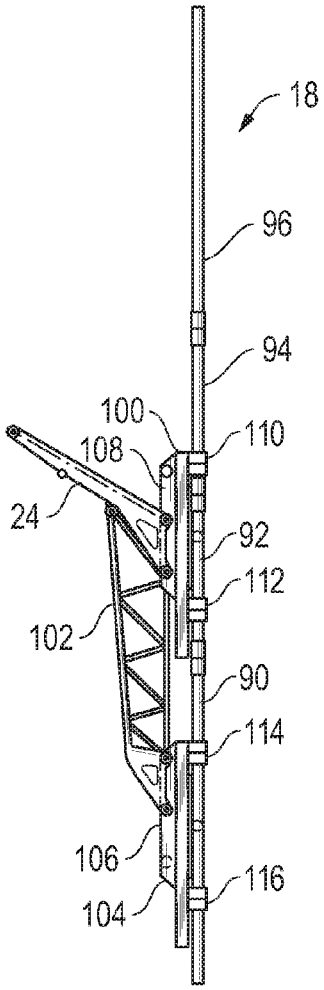
FIG. 7 is a side elevational view of a first alternative embodiment of the gripper assembly of the pipe handling apparatus.

Occasionally, it is necessary to accommodate longer lengths of pipe. In other circumstances, it is desirable to accommodate pipes that are already assembled in an extended length. In FIG. 7, it can be seen that the drill pipe 18 is formed of separate sections 90, 92, 94 and 96 that are joined in end-to-end connection so as to form an extended length of the of the pipe 18. When such pipe arrangements are required, the gripping means 26 of the present invention will have to be adapted so as to accommodate such extended lengths. Fortunately, the structure of the apparatus 10 of the present invention can accommodate such an arrangement. As can be seen in FIG. 7, the arm 24 is connected to a first gripper assembly 100 and connected by stab frame 102 to a second gripper assembly 104. The second gripper assembly 104 is located directly below and vertically aligned with the first gripper assembly 100. The stab frame 102 includes a suitable pin connection for engaging the body 106 of the second gripper assembly 104. The first gripper assembly 100 has body 108 that is directly connected to the pin connections associated with the arm 24. The gripping assembly 100 includes grippers 110 and 112 which engage in intermediate position along the length of pipe 18. The grippers 114 and 116 of the second gripper assembly 104 engage the lower portion of the pipe 18. The method of moving the pipe 18 from the horizontal position to the vertical position is similar to that described hereinbefore.

It should be noted that the arm 24 can extend at various angles with respect to the gripper assemblies 100 and 104. In the preferred embodiment, the arm 24 will be generally transverse to the length of the body associated with the gripper assemblies 100 and 104. However, if needed to accommodate certain drilling rig height and arrangements, the arm 24 can be angled up to 30° from transverse with respect to the body associated with the gripper assemblies 100 and 104.

Figure 8:
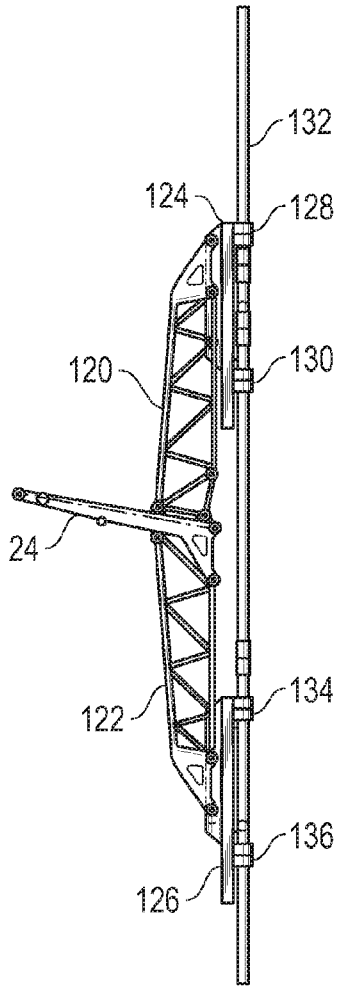
FIG. 8 is a side elevational view showing a second alternative embodiment of the gripper assembly pipe handling apparatus.

In FIG. 8, it an be seen that the arm 24 has a first stab frame 120 extending upwardly from the top of the arm 24 and a second stab frame 122 extending below the arm 24. The stab frame 120 includes a gripper assembly 124 affixed thereto. The stab frame 122 includes a gripper assembly 126 connected thereto. The arm 24 will include suitable pin connections located on the top surface thereof and on the bottom surface thereof so as to engage with the stab frames 120 and 122. The gripper assembly 124 has suitable grippers 128 and 130 for engaging an upper portion of the pipe 132. The gripper assembly 126 includes grippers 134 and 136 for engaging with a lower portion of the pipe 132. As illustrated in FIG. 8, the pipe 132 is a multiple section pipe. However, pipe 132 can be an extended length of a single pipe section.

Figure 9:
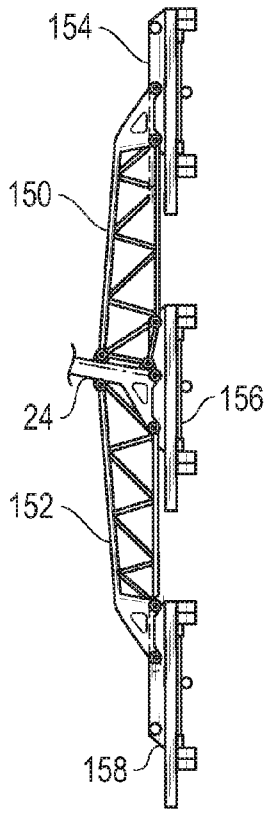
FIG. 9 is a side elevational view showing a third alternative embodiment of the gripper assembly of the pipe handling apparatus.

FIG. 9 shows still another embodiment of the gripper assembly structure of the present invention. In FIG. 9, the arm 24 is connected to the upper stab frame 150 and to the lower stab frame 152. Gripping assemblies 154,156 and 158 are provided. The gripper assembly 154 is connected to an upper end of the upper stab frame 150. The gripper assembly 158 is connected to a lower end of the lower stab frame 152. The gripper assembly 156 is intermediately located directly on the opposite side of the end of the arm 24 and connected to the lower end of the upper stab frame 150 and to the upper end of the lower stab frame 152. As such, the present invention provides up to three gripper assemblies 154, 156, and 158 to be connected. This can be utilized so as to accommodate even longer lengths of pipe, if needed.

The present invention achieves a number of advantages over the prior art. Most importantly, the present invention provides a pipe handling apparatus and method that minimizes the number of control mechanisms, sensors and hydraulic systems associated with the pipe handling system. Since the movement of the pipe is achieved in a purely mechanical way, only a single hydraulic actuator is necessary for the movement of the boom. All of the other movements are achieved by the interrelationship of the various components. As such, the present invention achieves freedom from the errors and deviations that can occur through the use of multiple hydraulic systems. The simplicity of the present invention facilitates the ability of a relatively unskilled worker to operate the pipe handling system. The amount of calibration is relatively minimal. Since the skid 12 associated with the present invention can be transported by a truck, various fine movements and the location of the pipe handling apparatus 10 can be achieved through the simple movement of the vehicle. The pipe handling apparatus 10 of the present invention is independent of the drilling rig. As such, a single pipe handling apparatus that is built in accordance with the teachings of the present invention can be utilized on a number of rigs and can be utilized at any time when required. There is no need to modify the drilling rig, in any way, to accommodate the pipe handling apparatus of the present invention. Since the pipes are loaded beneath the boom, the providing of the pipe to the pipe handling apparatus can be achieved in a very simple manner. There is no need to lift the pipes to a particular elevation or orientation in order to initiate the pipe handling system.

Figure 10:
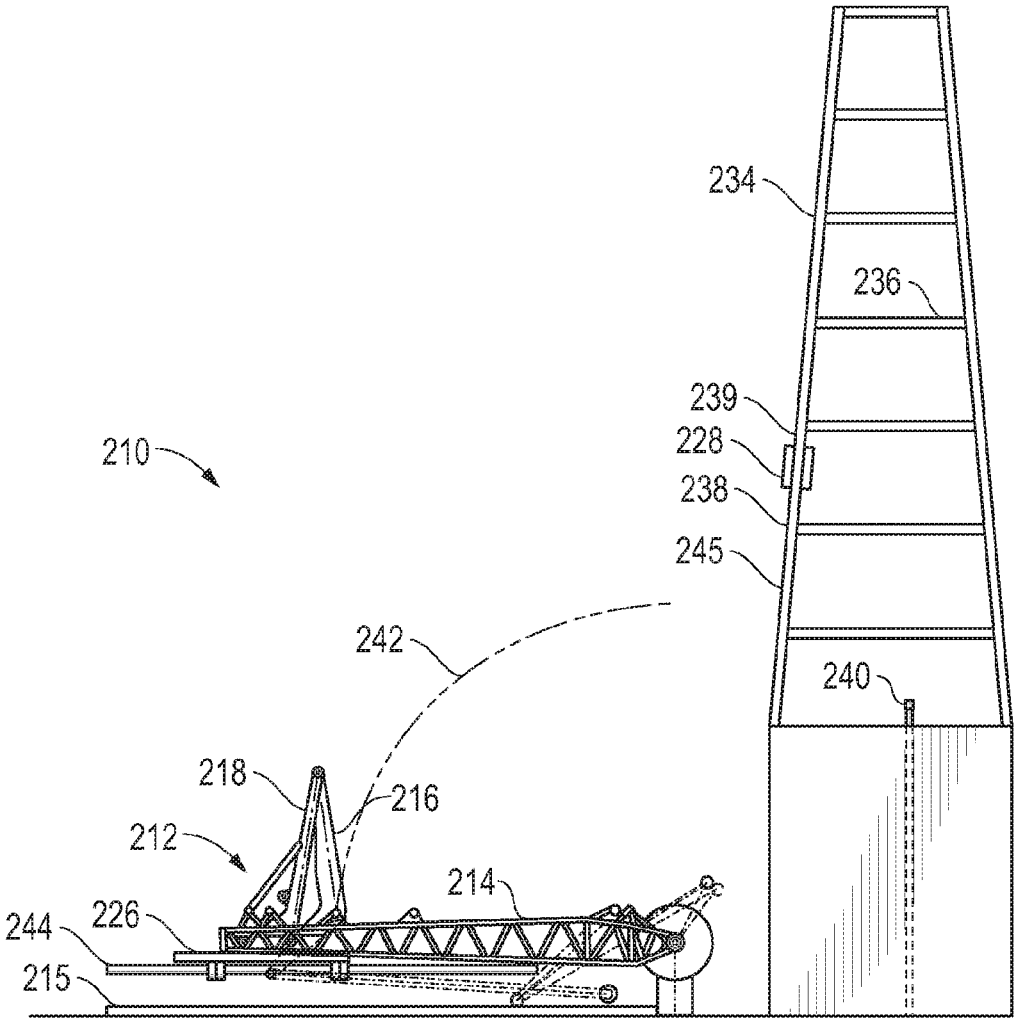
FIG. 10 shows a side elevational view of the preferred embodiment of the system of the present invention, with the pipe handling apparatus in a first position.

Referring to FIG. 10, there is shown a side elevational view of the preferred embodiment of the system 210 of the present invention, with the pipe handling apparatus 212 in a first position. The pipe handling apparatus 212 has a boom 214, a lever assembly 216, an arm 218, and a gripper 226. The boom 214 is pivotally connected the skid 215. The lever assembly 216 is pivotally connected to the boom 214. The arm 218 is pivotally connected to the lever assembly 216. The arm 218 is pivotally connected to the gripper means 226 opposite the lever assembly 216. The gripper means 226 holds a tubular 244 for transfer from a horizontal orientation to a vertical orientation as the pipe handling apparatus 212 moves from the first position to second position, described below. The tubular 244 can be a pipe, a casing, or any other tubular member. The tubular 244 is shown as in the horizontal orientation. Derrick 234 sits above a wellhead 240. As used herein, the term 'derrick' refers to derricks, masts, and similar structures associated with oil and gas production. The derrick 234 is centered over the wellhead 240. Derrick 234 has structural members 236. The structural members 236 can be of any orientation suitable for a typical derrick of an oil well. Structural members 236 of the derrick 234 are arranged so as to give the derrick 234 rigidity. The structural members 236 of the derrick 234 are arranged so as to form an opening called a window 238. The window 238 is located on the front 245 of the derrick 234. A header 228 is mounted in the window 238 on the front 245 of the derrick 234. More particularly, the header 228 is mounted near the top 239 of the window 238. As is described below, tubulars 244 are delivered by the pipe handling apparatus 212 to the wellhead 240 through the window 238.

Figure 11:
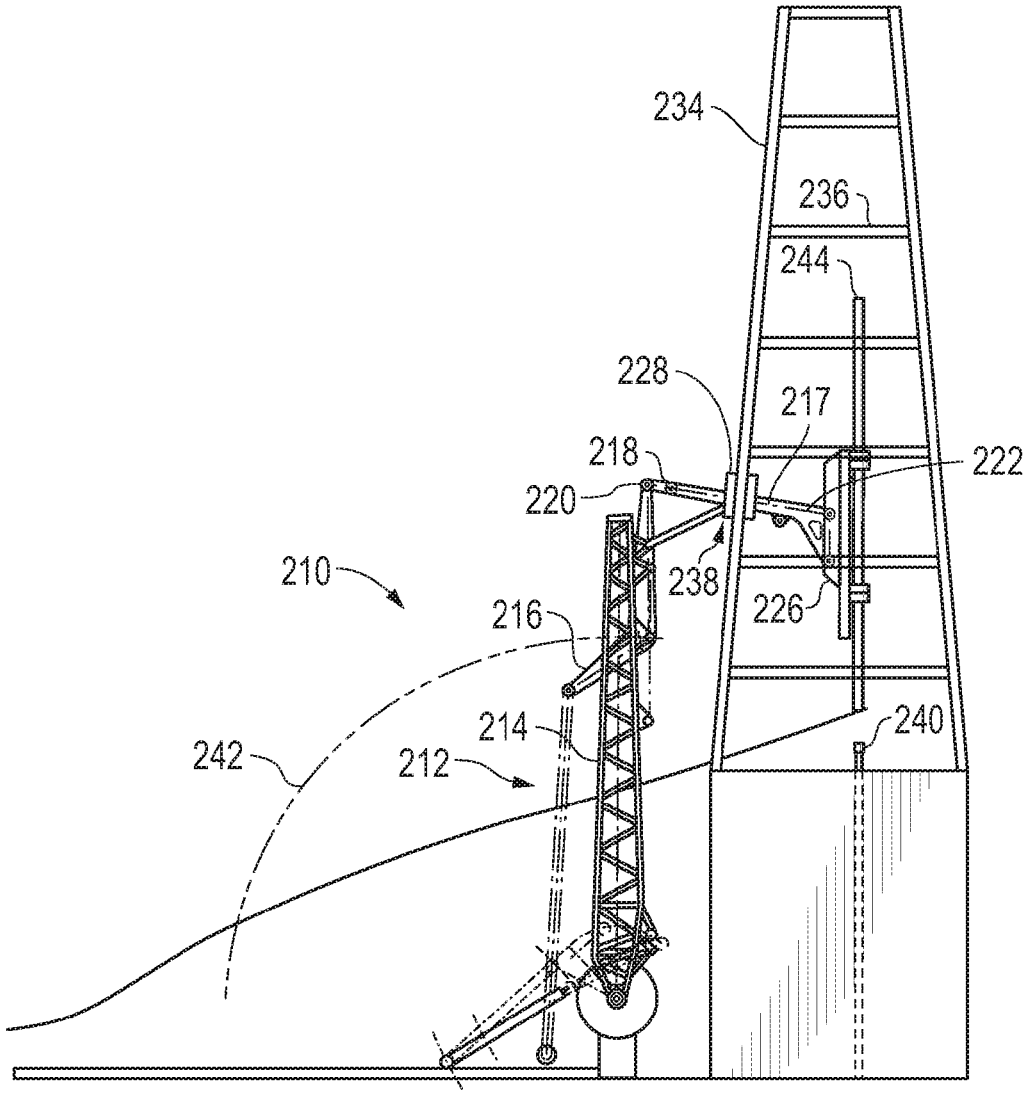
FIG. 11 shows a side elevational view of the preferred embodiment of the system of the present invention, with the pipe handling apparatus in a second position.

Referring to FIG. 11, there is shown a side elevational view of the preferred embodiment of the system 210 of the present invention, with the pipe handling apparatus 212 in a second position. In the second position, the pipe handling apparatus 212 delivers tubular 244 in a vertical orientation to the wellhead 240. The boom 214 is also in the second position, which is vertically oriented. The lever assembly 216 has pivoted with respect to the boom 214. End 220 of the arm 218 is pivotally connected to the lever assembly 216. The arm 218 extends outwardly from the lever assembly 216. The gripper 226 is affixed to an opposite end 222 of the arm 218. When the boom 214 is in second position, the header 228 receives a portion of the arm 218 therein. The header 228 helps guide the arm 218 towards the wellhead 240 so that the tubular 244 can be precisely aligned with the wellhead 240. Once the tubular 244 is delivered to the wellhead 240 in a vertical orientation, the gripper 226 releases the tubular 244. Normally, the gripper 226 and arm 218 would spring upwards after releasing the tubular 244. This "springback" of the gripper 226 and arm 218 can be up to ten inches. However, the header 228 prevents the springback of the gripper 226 and arm 218. The upward force of the arm 218 compresses the header 228 between the arm 218 and the window 238 of the derrick 234. The derrick 234 is an oil derrick. The header 228 resists the force created by the upward motion of the arm 218 after the gripper 226 releases the tubular 244. In other words, the header 228 exerts a downward force on the arm 218. It can be seen that the header 228 also extends around the sides 217 of the arm 218. Thus, the header 228 resists any sideways motion of the arm 218 due to springback, wind, or any source of sideways motion. In other words, the header 228 also exerts a horizontal force on the arm 218.

Figure 12:
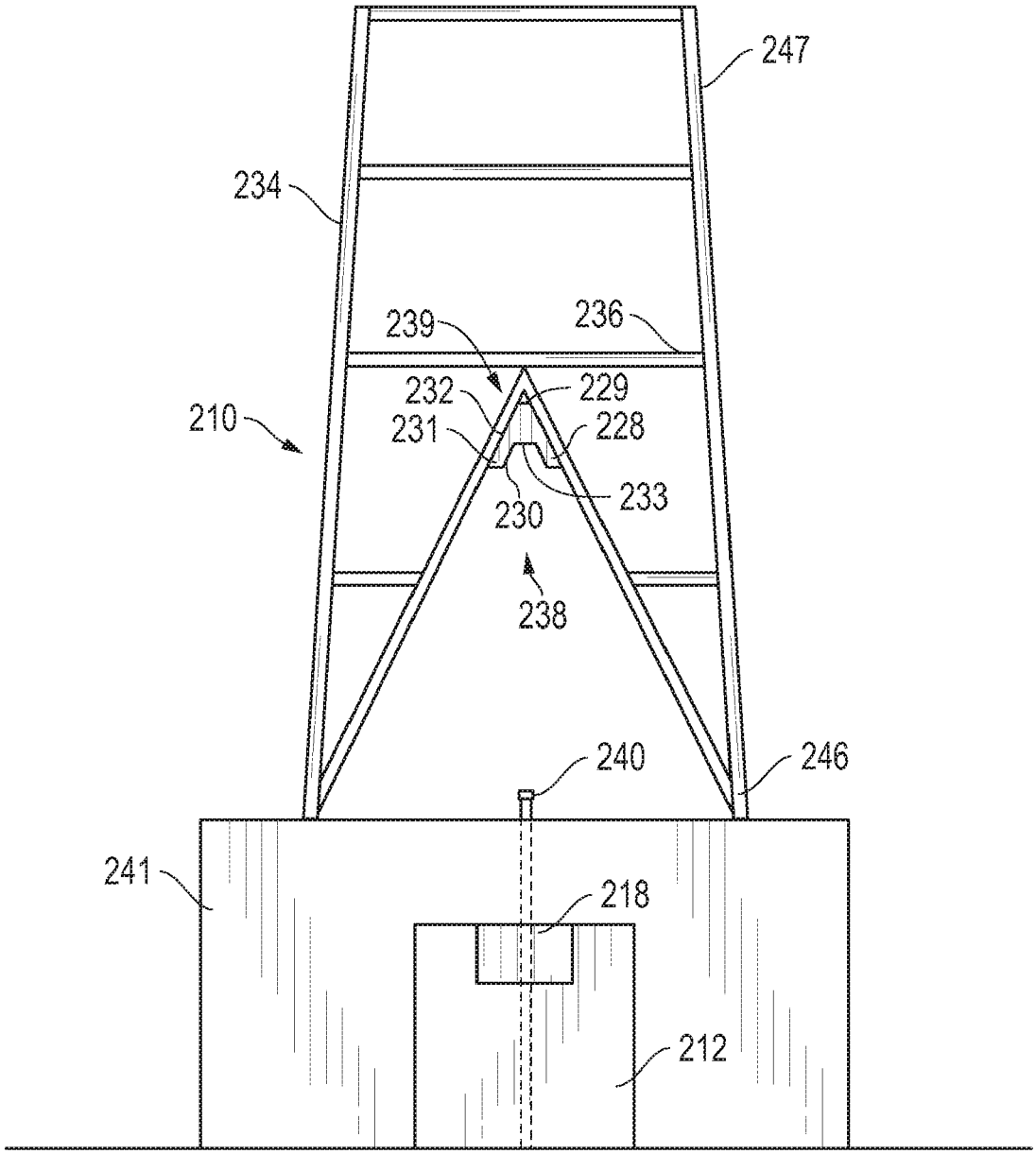
FIG. 12 shows a front elevational view of the preferred embodiment of the system of the present invention.

Referring to FIG. 12, there is shown a front elevational view of the system 210 of the present invention, with the pipe handling apparatus 212 in the first position. The wellhead 240 can be seen as extending upwardly from the well foundation 241. In normal operation, the pipe handling apparatus 212 is located below the wellhead 240. The oil derrick 234 has structural members 236. As discussed above in FIG. 10, the structural members 236 are arranged so as to form the window 238. In the embodiment shown in FIG. 12, the window 238 is formed of structural members 236 in an inverted V-shape. The V-shape of the structural members 236 is often referred to as the "V-door." At the widest point, the window 238 has a width approximately equal to a width of a bottom 246 of the derrick 234. The top 239 of the window 238 is located between the top 247 of the derrick 234 and the bottom 246 of the derrick 234.

The header 228 is mounted to the structural members 236 near the top 239 of the window 238. In FIG. 12, the header 228 is mounted near the apex of the inverted V-shape, but the present invention contemplates that the header 228 can be mounted anywhere in the window 238 that is suitable for receiving the arm 218 of the pipe handling apparatus 212. The header 228 can be made of any material and of any shape that is suitable for placing the header 228 in the window 238 of the derrick 234 and for receiving the arm of the pipe handling apparatus 212 therein. The header 228 has an inside surface 230 and an outside surface 232. The outside surface 232 is formed so as to suitably fit within the window 238 of the derrick 234. The inside surface 230 is formed so as to suitably receive the arm 218 of the pipe handling apparatus 212 when the pipe handling apparatus 212 delivers a tubular to the well head 240.

In FIG. 12, the header 228 has an A-shape so as to suitably fit near the top 239 of the V-shaped window 238. The header 228 can be of any other suitable shape depending on the shape of a given window for a given derrick. The header 228 has a body 229. The body 229 has a head 233 and legs 231 that extend downwardly from the head 233. The head 233 of the body 229 of the header 228 exerts a downward force when the arm 218 is placed adjacent the header 228. The legs 231 exert horizontal forces on the arm 218 so as to keep the arm aligned within the head 233 and legs 231 of the body 229 of the header 228. In the event of strong wind gusts, the legs 231 of the header 228 keep the pipe handling apparatus 212 from swaying side-to-side. That is, the legs 231 of the header 228 resists sideways motion of the arm 218 of the pipe handling apparatus 212. In the event that the pipe handling apparatus 212 is not aligned with the center of the wellhead 240, the legs 231 of the header 228 serve the further function of guiding the arm 218 of the pipe handling apparatus 212 to the center of the wellhead 240. The header 228 thus improves accuracy of the pipe handling apparatus 212. By guiding the pipe handling apparatus 212 and holding the pipe handling apparatus 212 in place while tubulars are delivered to the wellhead 240.

The header 228 is unique in that it has no moving parts and can be easily mounted to the window 238 formed by the structural members 236 of the derrick 234. The header 228 resists both upwardly and sideways motions of the arm of the pipe handling apparatus 212. The body 229 of the header 228 contacts the arm of the pipe handling apparatus 212 when the tubular is in the vertical orientation. The header 228 is compressed between the arm 218 and the window 238.

The foregoing disclosure and description of the invention is illustrative and explanatory thereof. Various changes in the details of the illustrated construction and method can be made within the scope of the present claims without departing from the true spirit of the invention. The present invention should only be limited by the following claims and their legal equivalents.

I claim:

1. A system for resisting upward movement of an arm of a pipe handling apparatus, the system comprising:

a derrick having structural members that form a window therein;

a pipe handling system having an arm that rises into the window of the derrick to deliver or receive a tubular held in a vertical orientation;

a header having an outside surface configured for attachment to the structure of the derrick, and having the outer surface attached to the structure of the derrick;

the header having a slot configured to receive the arm of the pipe handling system when the arm is extended into the derrick to deliver or receive the tubular to a location above a well head located beneath the derrick; and, whereas when delivering the tubular to the well head, the arm of the pipe handling system engages the slot of the header as the tubular reaches a position over the well head, such that the header resists further upwardly motion of the arm to pretension the pipe handling system.

2. The system of claim 1, wherein the header includes a body, the body configured to fit within the window of the derrick, the body having the slot formed therein to receive a portion of the arm of the pipe handling system.

3. The system of claim 2, the body comprising:

a head mounted in the window and receiving a portion of the arm beneath it so as to resist an upward motion of the arm when the pipe handling system is in the second position; and at least one leg extending downwardly from a side of the head, the leg being mounted in the window and receiving a portion of the arm against it so as to resist a sideways motion of the arm, when the pipe handling system is in the second position.

4. The system of claim 3, the head and the leg being integrally formed.

5. The system of claim 1, wherein the window of the derrick includes an inverted V-shape, and the header comprises a body having a V-shape configured to fit within the inverted V-shape of the window of the derrick.

6. A system for resisting upward movement of an arm of a pipe handling apparatus, the system comprising:

a pipe handling apparatus having an arm for lifting a pipe from a horizontal to a vertical orientation;

a derrick having a window configured to receive a pipe there through;

a header within the window having an outside surface configured for attachment to the structure of the derrick, the outer surface attached to the structure of the derrick;

the header having a slot configured to receive the arm of the pipe handling system when the arm is extended into the derrick to deliver or receive the tubular to a location above a well head located beneath the derrick; and, whereas when delivering the tubular to the well head, the arm of the pipe handling system engages the slot of the header as the tubular reaches a position over the well head, such that the header resists further upwardly motion of the arm to pretension the pipe handling system.

7. The system of claim 6, wherein the window comprises an inverted V-shape and the header comprises an A-shape and is configured to fit within the window.

8. The system of claim 6, wherein an upper surface of the portion of the arm abuts against an underside of the header.

9. The system of claim 6, wherein a side surface of the header restrains the portion of the arm from lateral movement.

10. The system of claim 6, wherein the slot is configured to receive the portion of the arm and restrain upward and lateral movement of the arm.

11. A system for resisting upward movement of an arm of a pipe handling apparatus, the system comprising:

a pipe handling apparatus for lifting a pipe from a horizontal to a vertical orientation;

a vertical structure comprising elongate structural members;

a window in the vertical structure, the window sized and configured to receive there through a pipe held by grippers at one end of an arm of the pipe handling apparatus; and a header within the window having an outside surface configured for attachment to the structure of the derrick, the outer surface attached to the structure of the derrick;

the header having a slot configured to receive the arm of the pipe handling system when the arm is extended into the derrick to deliver or receive the tubular to a location above a well head located beneath the derrick; and, whereas when delivering the tubular to the well head, the arm of the pipe handling system engages the slot of the header as the tubular reaches a position over the well head, such that the header resists further upwardly motion of the arm to pretension the pipe handling system.

12. The system of claim 11, wherein the window comprises an inverted V-shape and the header comprises a V-shape and is configured to fit within the window.

13. The system of claim 11, wherein an upper surface of the portion of the arm abuts against an underside of the header.

14. The system of claim 11, wherein a pair of opposed side surfaces of the header restrains the portion of the arm from lateral movement.

15. The system of claim 11, wherein the slot is configured to receive the portion of the arm and restrain upward and lateral movement of the arm.

16. The system of claim 11, wherein an upper surface of the portion of the arm abuts against an underside of the header to restrain upward movement of the arm and a pair of opposed side surfaces of the header restrains the portion of the arm from lateral movement.

17. A system for resisting upward movement of an arm of a pipe handling apparatus, the system comprising:

a derrick having a window formed therein;

a header within the window of the derrick, the header configured to restrain from upward motion a portion of the arm of the pipe handling apparatus when the arm is extended into the derrick holding a pipe in a vertical orientation;

the header including a body, the body configured to fit within the window of the derrick, the body including a slot formed therein to receive a portion of the arm of the pipe handling apparatus;

the body comprising:

a head mounted in the window and receiving a portion of the arm beneath it so as to resist an upward motion of the arm when the pipe handling apparatus is in the second position; and, at least one leg extending downwardly from a side of the head, the leg being mounted in the window and receiving a portion of the arm against it so as to resist a sideways motion of the arm when the pipe handling apparatus is in the second position.

* * * * *